US006793004B2

(12) United States Patent
Yamazaki et al.

(10) Patent No.: US 6,793,004 B2
(45) Date of Patent: Sep. 21, 2004

(54) TEMPERATURE CONTROL UNIT AND TEMPERATURE CONTROL APPARATUS USING IT FOR RAW MOLDING SAND OR RESIN-COATED SAND FOR SHELL MOLD

(75) Inventors: Motoyoshi Yamazaki, Aichi-ken (JP); Tomio Kuwatani, Nagoya (JP); Masanao Tokoro, Gifu-ken (JP)

(73) Assignees: Asahi Organic Chemicals Industry Co., Ltd., Miyazaki (JP); Tokoro Product, Inc., Gifu-Ken (JP)

( * ) Notice: Subject to any disclaimer, the term of this patent is extended or adjusted under 35 U.S.C. 154(b) by 0 days.

(21) Appl. No.: 10/244,754

(22) Filed: Sep. 17, 2002

(65) Prior Publication Data

US 2004/0050527 A1 Mar. 18, 2004

(51) Int. Cl.[7] ..... B22C 5/08
(52) U.S. Cl. ..... 164/412; 164/200
(58) Field of Search ..... 164/5, 200, 201, 164/202, 19, 20, 21, 412; 221/174

(56) References Cited

U.S. PATENT DOCUMENTS 4,821,654 A * 4/1989 Becker et al. ..... 110/236
5,291,935 A * 3/1994 Godderidge ..... 164/5
6,019,157 A * 2/2000 Kanno et al. ..... 164/5

FOREIGN PATENT DOCUMENTS

| | | | | |
|---|---|---|---|---|
| DE | 3642917 A1 | * | 6/1988 | ..... B22C/5/00 |
| JP | 54-35127 | | 10/1979 | |
| JP | 55-109541 | | 8/1980 | |
| JP | 359097737 | * | 6/1984 | |
| JP | 59-35318 | | 9/1984 | |
| JP | 59-191540 | | 10/1984 | |
| JP | 359191540 | * | 10/1984 | |
| JP | 360187446 | * | 9/1985 | |
| JP | 362220245 | * | 9/1987 | |
| JP | 363180340 | * | 7/1988 | |

* cited by examiner

*Primary Examiner*—Kiley Stoner
*Assistant Examiner*—Len Tran
(74) *Attorney, Agent, or Firm*—Burns Doane Swecker & Mathis LLP

(57) ABSTRACT

A temperature control unit for raw molding sand or resin-coated sand for a shell mold according to the present invention comprises a heat exchanger (A) consisting of a spiral hollow tube allowing heat carrier to flow, and a gas distribution tube assembly for making powder flow (B) for supplying gas to cause the flow of molding sand or resin-coated sand for a shell mold. Furthermore, a temperature control apparatus according to the present invention comprises a reservoir for raw molding sand or resin-coated sand for a shell mold, and said temperature control unit provided in said reservoir.

20 Claims, 4 Drawing Sheets

TEMPERATURE CONTROL UNIT AND TEMPERATURE CONTROL APPARATUS USING IT FOR RAW MOLDING SAND OR RESIN-COATED SAND FOR SHELL MOLD

BACKGROUND OF THE INVENTION

1. Field of the Invention

The present invention relates to a temperature control unit, and a temperature control apparatus using it, for resin-coated sand used in a shell molding process for sand-casting, raw molding sand used in an organic material cold-self-hardening-nature process or a cold box process, etc., in a flowing state (the raw molding sand or resin-coated sand used in shell molding process are collectively referred to hereinafter as "powder").

2. Description of the Related Art

As an example, resin-coated sand is molding sand coated with bonding material such as thermosetting phenol resin, which is baked after being charged into a heated mold to be formed in a mold. Furthermore, for example, although mixed sand used in a cold-box process has the property of being susceptible to the temperature at molding, the raw molding sand with which the sintering material-coated sand is made is used with little temperature control.

However, resin-coated sand is apt to cause a reduction in the productivity of a mold due to the extension of baking time, the occurrence of mold breakage, etc. in winter, while the sintering material-coated sand, for a cold-box process, made of ambient temperature raw molding sand without temperature control becomes hard slowly in winter and the time the sintering material-coated sand can be able to be used is short in summer, thereby interfering with the molding.

Up to now, it has been considered that a heat exchanging process (heating or cooling) by a temperature control apparatus such as a heating apparatus for heating powder while keeping it in a fluidizing state with blown up warm air (Japanese Examined Utility Model Publication No.59-35127, Japanese Unexamined Patent Publication No.55-109541), a heating and cooling apparatus having tubes allowing a heat carrier to flow within a temperature control bath (Japanese Examined Utility Model Publication No.59-35318), and a heating apparatus for heating powder while blowing warm air down (Japanese Unexamined Patent Publication No.59-191540), etc., serves a useful function for such powder which is susceptible to ambient temperature.

However, those temperature control apparatuses have not become widespread because it is difficult to reduce the installation cost or the installation space as they are in general large, for processing a large quantity of powder, and require appurtenant work for conveying the powder to the place where the powder is used after the heat exchanging process. In such circumstance, it has been desired to develop a small temperature control apparatus capable of being installed at each service place such as a mixer for manufacturing sintering material-coated sand used for a cold-box process or a molding machine for shaping a mold.

It is therefore an object of the present invention to provide a temperature control unit which can be used to modify various existing or newly installed hoppers, as a related apparatus of a mold shaping machine or mixer, including, for example, a powder receiving reservoir (called "powder reservoir" hereinafter) shaped like a cone, cylinder tube, rectangular tube, or diameter-decreased tube, to a temperature control apparatus which has a heat exchanging ability corresponding to the amount of powder to be processed, is able to prevent the occurrence of dust from the powder and the exfoliation of the resin film of the powder, and is smaller than conventional temperature control apparatuses. It is another object of the present invention to provide a temperature control unit which is able to allow a satisfactory flow, in the heat exchange portion, of the powder conveyed into the reserving portion of a powder reservoir irrespective of the weight of the powder, and the supply of the powder from the reserving portion to the heat exchange portion without any trouble, and thus allow the continuous processing for the powder. It is further object of the present invention to provide a temperature control apparatus capable of switching between the heating and cooling of powder.

SUMMARY OF THE INVENTION

The inventor et al found that their predetermined goal can be accomplished by using a temperature control unit basically comprising a particular heat exchanger and a particular gas distribution tube assembly for making powder flow, after due consideration mainly of downsizing a temperature control apparatus, and have made further study based on this finding to accomplish the present invention.

The present invention relates to:

(1) a temperature control unit for raw molding sand or resin-coated sand for a shell mold, comprising a heat exchanger A consisting of a spiral hollow tube (called "spiral heat exchanger A" hereinafter) allowing a heat carrier ("Heat carrier" means a heat carrier used for heating and a heat carrier used for cooling in this specification.) to flow, and a gas distribution tube assembly for making powder flow for supplying gas to cause the flow of raw molding sand or resin-coated sand for a shell mold (powder);

(2) preferably a temperature control unit of (1) further comprising a buffer C for preventing the influence of the weight of raw molding sand or resin-coated sand for a shell mold (powder) disposed above the spiral heat exchanger A and/or under the gas distribution tube assembly for making powder flow B; or (3) a temperature control unit of (1) or (2), wherein the lower part of the gas distribution tube assembly B for making powder flow has a plurality of gas diffusing holes.

The present invention further relates to:

(4) a temperature control apparatus for raw molding sand or resin-coated sand for a shell mold (powder) comprising a reservoir for raw molding sand or resin-coated sand (powder) in which the temperature control unit of anyone of (1) to (3) is installed;

(5) preferably a temperature control apparatus of (4) further comprising a pair of level controller disposed on the reserving portion 1 at the upper part of the reservoir for raw molding sand or resin-coated sand (powder); or (6) a temperature control apparatus of (4) or (5) capable of switching between the heating or cooling of raw molding sand or resin-coated sand for a shell mold.

Figure 1:
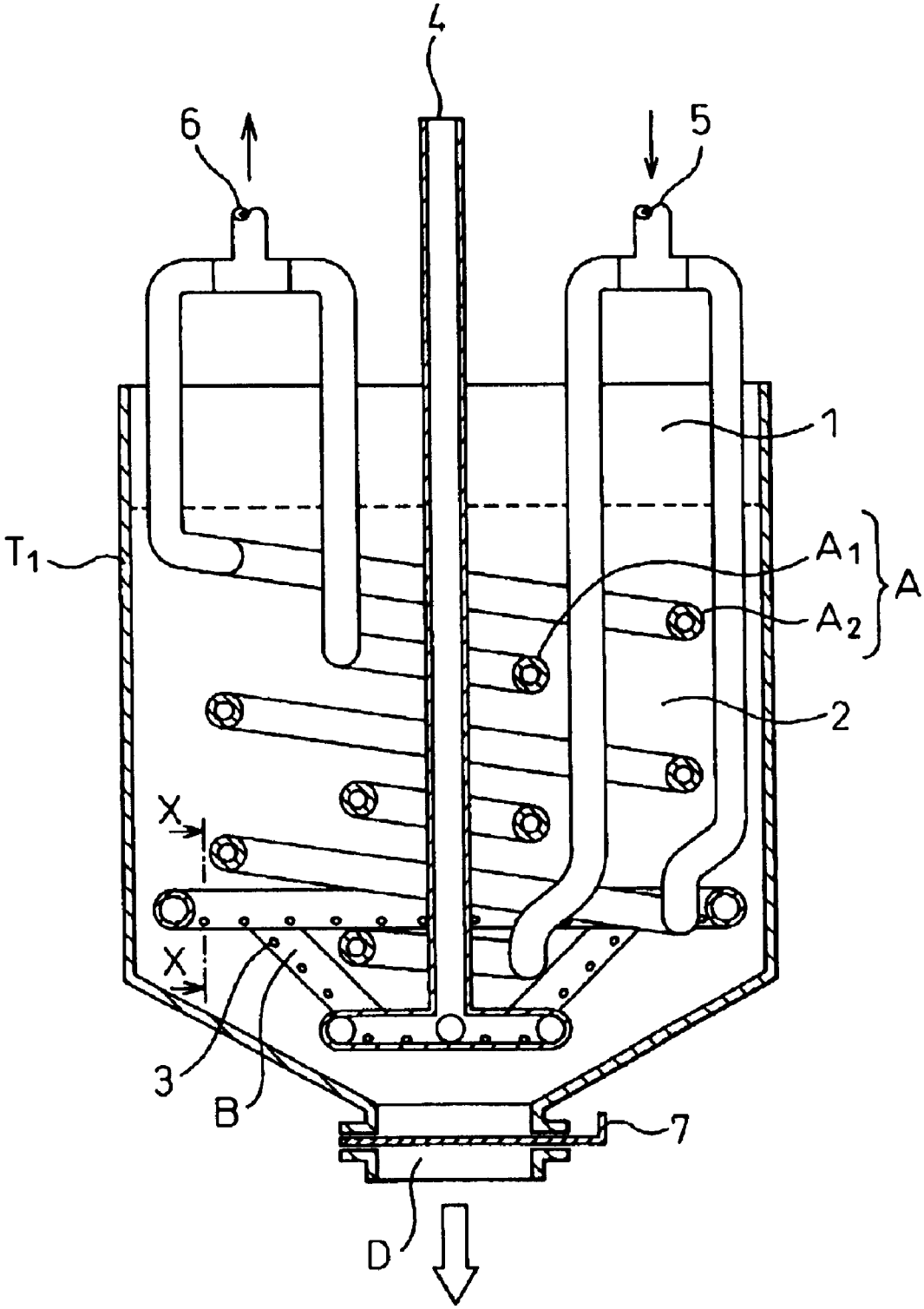
FIG. 1 is a vertical cross-sectional view of a temperature control apparatus comprising an existing circular powder reservoir T1 in which a temperature control unit of an embodiment of the present invention is installed.

(A1,A2) . . . Spiral heat exchanger

B . . . Gas distribution tube assembly for making powder flow

C . . . Powder buffer

D . . . Outlet

T . . . Powder reservoir (L1,L2) . . . Level controller

1 . . . Reserving portion

2 . . . Heat exchange portion

3 . . . Gas diffusing hole

4 . . . gas inlet

5 . . . Heat carrier inlet

6 . . . Heat carrier outlet

7 . . . Shutter

DESCRIPTION OF THE PREFERRED EMBODIMENTS

The preferred embodiments of the present invention are described below with reference to the drawings. FIG. 1 is a vertical cross-sectional view of a temperature control apparatus of a first embodiment of the present invention. The temperature control apparatus comprises an existing circular powder reservoir T1 having an outlet D equipped with a shutter 7 at the lower part of it, and a temperature control unit installed in the reservoir T1. The temperature control unit consists of two independent spiral heat exchangers A (A1, A2) and a gas distribution tube assembly for making powder flow B. The spiral heat exchangers A1, A2 have a diameter (mϕ, nϕ) different from each other, and have a common heat carrier inlet 5 and a common heat carrier outlet 6. The gas distribution tube assembly B has a gas inlet 4 and gas diffusing holes 3. The temperature control apparatus has two portions, a reserving portion 1 and a heat exchange portion 2.

Instead of the above spiral heat exchangers A, two spiral heat exchangers having a same diameter or one spiral heat exchanger having increased-diameters or decreased-diameters may be used. Furthermore, a plurality of the spiral heat exchangers may be arranged vertically, in parallel, or concentrically, and thereby the constructive vertical and horizontal extent of the heat exchangers (A1, A2, . . . ), that is, the vertical and horizontal extent of the heat exchange portion 2 corresponding to the shape of the powder reservoir T may be obtained. Furthermore, excellent heat exchanging ability (heat exchanging area and heat exchanging ratio) derived from the spiral shape and the quality of the material of the heat exchanger may be obtained. Thus, the powder in the heat exchange portion 2 may be heated or cooled evenly and effectively irrespective of the depth or the extent of the powder, and thereby the temperature of the powder may be increased or decreased to the desired value smoothly. Furthermore, the spiral heat exchanger allows the powder to effectively move down by its weight so that the attachment or contact of the powder to the heat exchanger, etc. may be prevented as necessary and the powder may be discharged smoothly by the cooperation between the heat exchanger and the gas (air) which has been distributed from the gas distributing tube for making powder flow B and exists between the particles of the powder.

Figure 6:
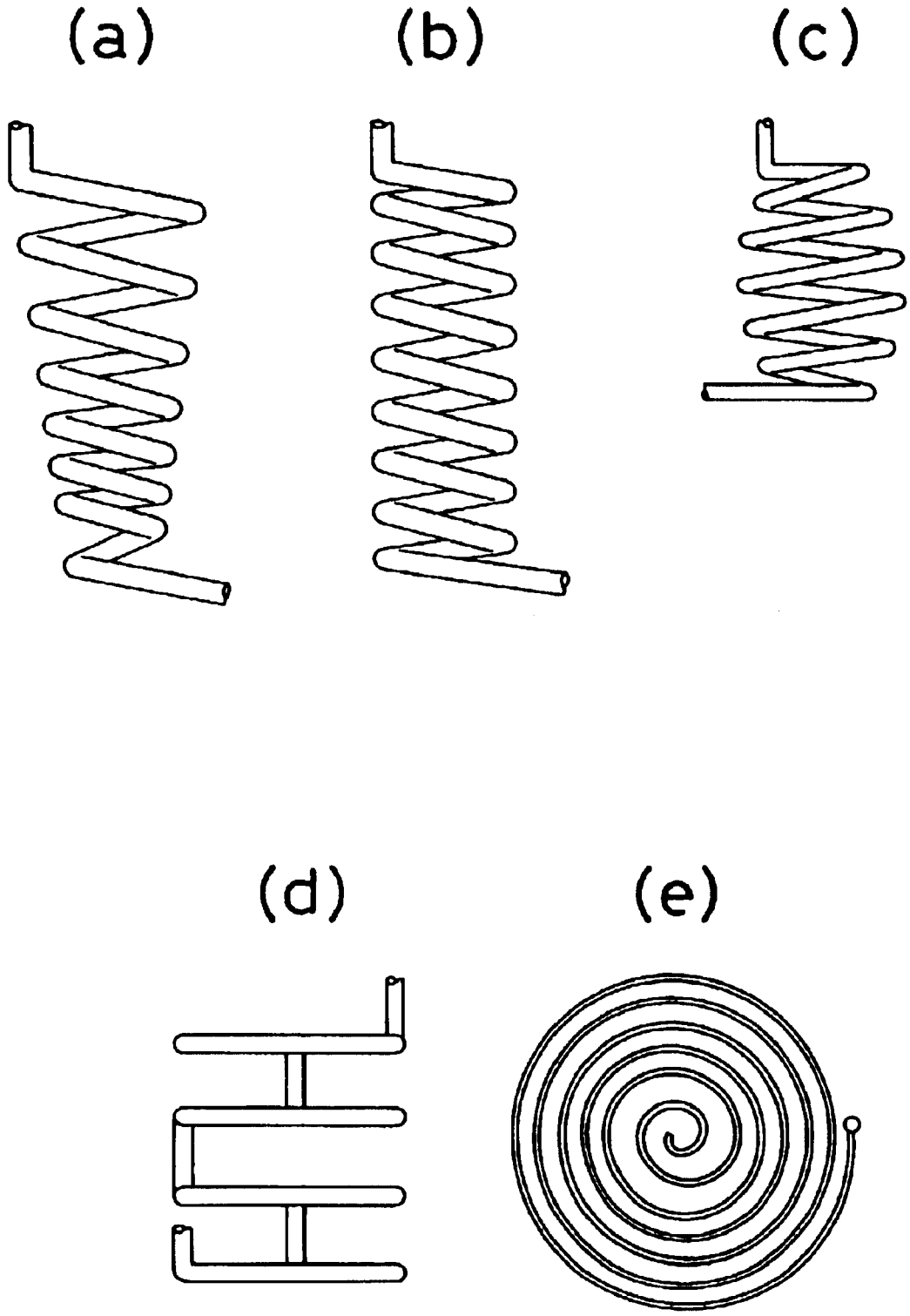
FIGS. 6(*a*), (*b*), (*c*), (*d*), or (*e*) shows an example shape of the spiral heat exchanger A, and (e) shows a plane spiral component of the spiral heat exchanger of (d).

Each of the heat exchangers A consists of a spiral hollow tube. A copper tube having an internal diameter mainly of 5 to 30 mm, preferably 8 to 20 mm, is adopted as the spiral hollow tube mainly from heat exchange ability and workability points of view, and is shaped like, for example, a spiral as shown in FIG. 6 (for example, (a) cone, (b) cylinder tube, (c) sectional warping drum or other irregular shaped coil, (d) plane spiral, or (e) vertically arranged spiral). In particular, a shape like an inclined spiral is preferable in terms of preventing a build-up of the powder and the flow of the heat carrier. There is no limit to the material for the hollow tube provided that the aforementioned conditions are met. The length of the copper tube is decided in consideration of the processing conditions (quantity, temperature, operation cycle) for the powder. For example, the length of 12 mmϕ copper tube necessary to increase the temperature of 26 kg raw molding sand from 5° C. to 40° C. in one minute is approx. 80 m in total. Furthermore, there is no limitation to the installation interval and spiral pitch of the heat exchangers because they are decided based on the observation of the state of powder flow, but experience shows that the order of 30 mm is required for each of them.

Furthermore, the heat carrier for heat exchange is supplied from, for example, a heat carrier supply device to the inlet 5 through a flow control valve and a flow meter, and then flows in the spiral heat exchanger A, and returns to the heat carrier supply device from the outlet 6 through a return circuit (not shown). During such circulation of the heat carrier, heat transfers from the heat carrier to the gas being blown out of the gas diffusing holes 3 of the gas distributing tube for making powder flow, or vice versa, and also transfers from the gas to the powder flowing while making contact with the gas, or vice versa. In some cases, heat transfers directly from the heat carrier to the powder at rest, or vice versa. Such indirect and/or direct heat transfer between the heat carrier and the powder increases or decreases the powder temperature to a predetermined value. Water is a most suitable heat carrier in terms of the ease of temperature control and/or switching between heating and cooling, and the cost of manufacturing and operation. But the heat carrier is not always limited to water, and another medium may be used. In case of heating, 40 to 90° C. hot water is normally used, and in particular, 50 to 80° C. hot water is used when anti-blocking is required. On the other hand, in case of cooling, ambient temperature water or cold water is, of course, normally used. In particular, it is easy to stop or restart the heating or cooling by the combination of the spiral heat exchanger used in the present invention and a heat carrier supply device capable of switching between heating and cooling which is not shown in the drawings, and thereby the spiral heat exchanger contributes to reduced work in such a manner that the worker is liberated from an annoyance such as the work of discharging the powder from the temperature control apparatus in an intermission or at the end of work.

The gas distributing tube B constituting the temperature control apparatus according to the present invention has a gas inlet and a plurality of gas diffusing holes provided at a desired interval through which the inside the tube communicates with the outside, the gas inlet receiving ambient temperature pressured gas, or generally air, dehumidified air, or cooled air, or in some cases mixture of inert gas such as nitrogen gas and air, or inert gas (these gases are collectively referred hereinafter simply as "gas"), supplied from a pressure gas supply unit (for example, a blower, a compressor, or a pressured bomb) which is not shown in the drawings.

Figure 4:
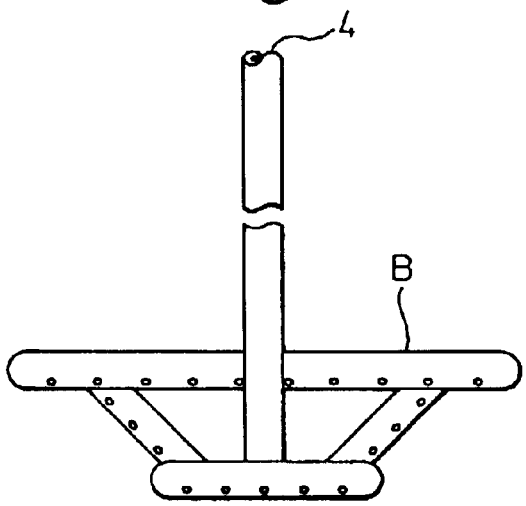
FIG. 4 is a front view of the conical gas distribution tube assembly B shown in FIG. 3.
Figure 5:
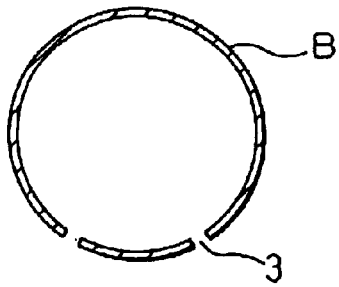
FIG. 5 is a cross-sectional view on line X—X of the gas distribution tube assembly for making powder flow B shown in FIG. 1, showing gas diffusing holes disposed at suitable positions.

The gas diffusion holes 3 are made to have an opening with suitable angle or direction, or to be a covering-structure (e.g., Twyer), so as to be resistant to cause the clogging of the tube or a short path of the gas due to the powder which has entered the tube when the supply of the pressurized air has been stopped. Most of all, the gas diffusion holes 3 are preferably made on the part lower than the center line of the horizontal tube or the tilted tube as shown in FIG. 4. The form of the gas diffusion hole is preferably but not limited to circle from low diffusing resistance (pressure loss) and ease of work points of view. The diameter of the hole is 1 to 6 mmϕ, but preferably 2 to 4 mmϕ in consideration of the control of state of powder flow and the discharge gas pressure, the prevention of the generation of "the short path" for the gas, variations in discharged gas amount, the increase in the gas supply ability of the gas supply unit, etc. Furthermore, it is preferable in order to accomplish even heat transfer that the gas diffusing holes are preferably small in size and few in number at the places where the gas pressure is high, and even heat transfer holes are large in size and number at the places where the gas pressure is low. Furthermore, the holes may also be provided on the vertical tube of the gas distribution tube assembly at the places where the powder does not clog the holes.

There is no limit to the shape of the gas distribution tube assembly for making powder flow because it is decided according to the shape of the powder reservoir. However, the gas distribution tube assembly may have a shape like a cone as shown in the embodiment, a circle, a circular cylinder, a rectangular cylinder, a pyramid, or a radial form, or may be so configured that tubes in some of these shapes are combined, or a plurality of tubes in any one of these shapes are vertically arranged. The gas distribution tube assembly for making powder flow is generally made of metal. There is no limit to the material of the gas distribution tube assembly, which may be made of other material such as pottery, fiber reinforced plastic, or plastic.

The gas discharged from the gas diffusing holes 3 of such a gas distribution tube assembly B for making powder flow allows the powder to flow, and heats up or cools down the powder. The gas is generally supplied continuously or intermittently according to the property of the powder. For example, when the powder such as resin-coated sand being susceptible to heat is used, the gas is preferably supplied continuously with a blower, on the other hand, when the powder such as molding sand, to which any change in its property is not made by heat, is used, the gas is preferably supplied intermittently with a compressor. In addition, in the present invention, as the spiral heat exchanger which is excellent in heat exchange ability as described above, and hot or cold water are preferably used, the amount and pressure of the gas discharged from the holes which causes a fluidizing state of the powder or "the short path" for the gas much appeared in the conventional apparatuses are not required, but it is essential only that the gas of the amount causing the powder to be filled with the gas as a heat carrier, and of the discharged pressure causing small-flow state or flow state which prevents the powder to rest and allows the replacement or mixing of the powder, that is, causing the movement of the powder or not causing the floating of the powder, can be supplied. The discharge pressure of the gas at the gas supply unit is not restricted because it varies according to kind of powder or amount of powder to be processed, structure of the powder reservoir, diameter of the gas diffusing holes, etc. However experience shows that the discharge pressure of the gas is the order of 0.005 to 0.02 Mpa when supplied continuously with a blower, but in the order of 0.2 to 0.4 Mpa when supplied intermittently with a compressor, and the amount of the gas is the order of 1 to 1.5 $m^3$ per minute. For this reason, the present invention has such an advantage that the exfoliation of the resin film of the powder and the occurrence of dust from the powder at the floating treatment of the powder can be prevented. The gas used in the heat exchange portion diffuses and flows up to the reserving portion. While the gas is diffusing and flowing up to the reserving portion, heat transfers from the gas to the unprocessed powder, or vice versa, and then waste heat is exhausted to the outside of the powder reservoir. This contributes to the reduction of heat treatment cycle and energy cost. In order to utilize more waste heat and further prevent the occurrence of dust from the powder, the powder reservoir is preferably provided with an exhaust port (not shown) and a cover having an opening such as an inlet for receiving unprocessed powder.

Furthermore, a vibration portion or vibration transfer portion is provided on the gas distribution tube assembly for making powder flow to vibrate the tube assembly continuously, and intermittently when the powder is apt to build up, and thus the powder can be discharged smoothly from the outlet D.

The gas distribution tube assembly for making powder flow B is preferably disposed relatively under the spiral heat exchanger A so that the powder (e.g., resin-coated sand, or molding sand) temperature which has been controlled to a predetermined value is discharged easily and heat transfer between the powder and the heat carrier is carried out efficiently. For example, the gas distribution tube assembly B is preferably so disposed that even if part of it (or one of tubes if it is constituted by a plurality of the tubes) is disposed at the same level as part of the spiral heat exchanger A, the gas diffusing holes provided at the lower part of the gas distribution tube assembly B are disposed near the powder outlet D more than the bottom of the spiral heat exchanger A. The gas distribution tube assembly may be disposed apart from the spiral tube, or so configured that a vertical tube is inclined, so that the powder does not build up. Furthermore, a plurality of gas distribution tubes for making powder flow may be arranged vertically or in parallel. The number and the arrangement of the gas distribution tubes B, the spiral heat exchanger A and/or the powder buffer C may be decided in consideration of the relation between them.

Figure 2:
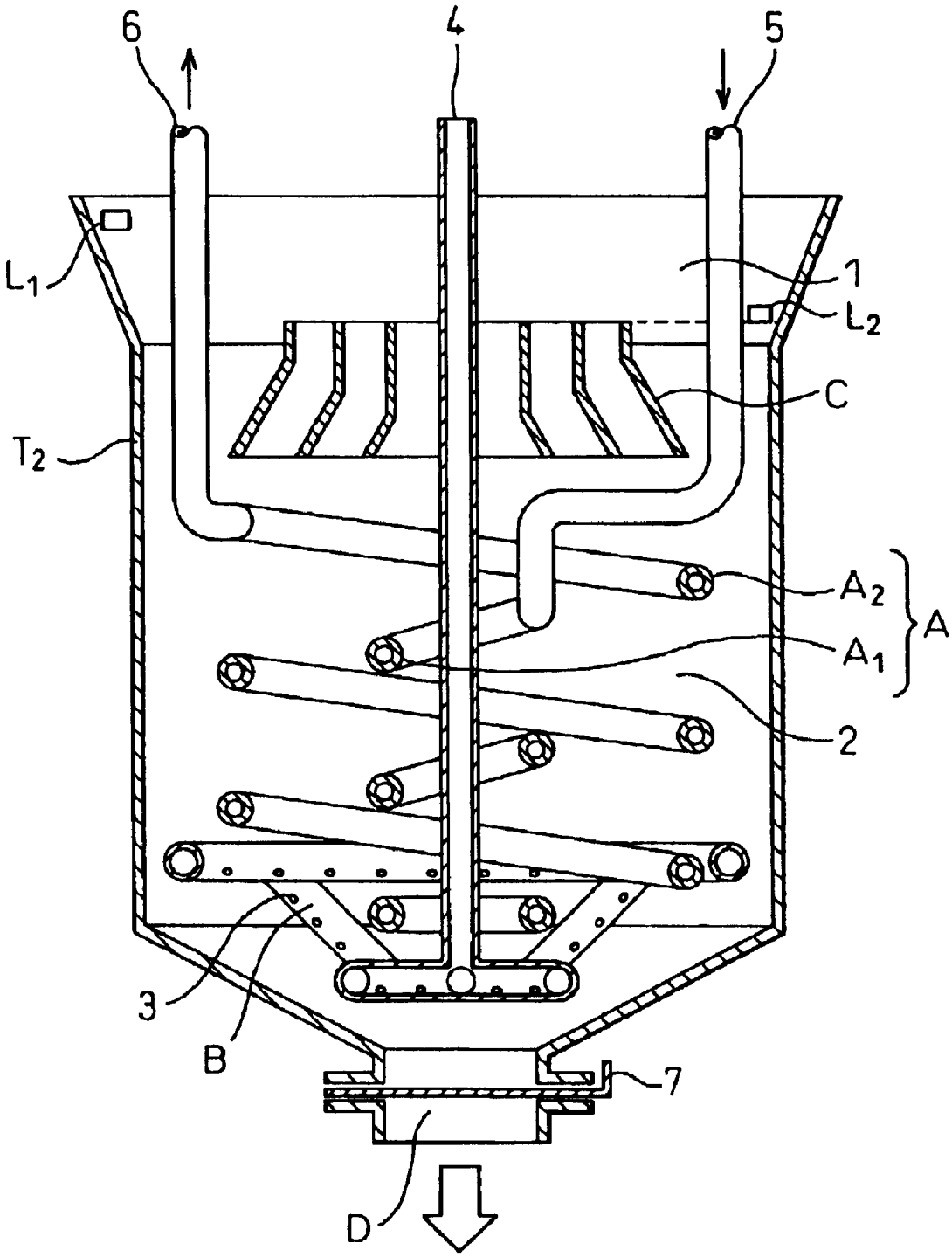
FIG. 2 is a vertical cross-sectional view of a temperature control apparatus comprising an existing diameter-decreased circular powder reservoir T2 in which a temperature control unit of an embodiment of the present invention is installed.
Figure 3:
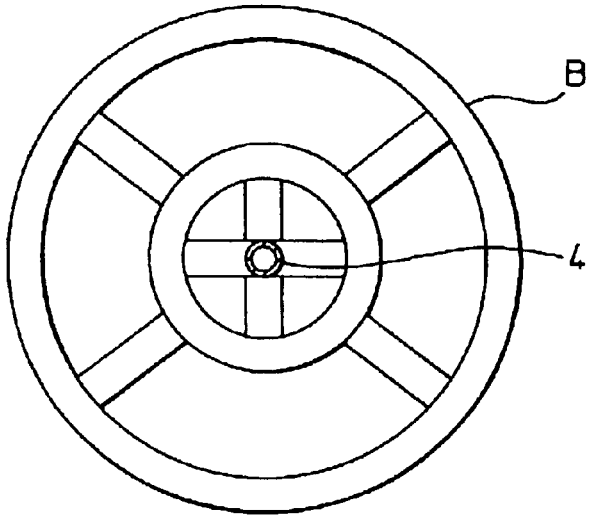
FIG. 3 is a plan view of the conical gas distribution tube assembly for making powder flow B shown in FIG. 1 or FIG. 2.

FIG. 2 is a vertical cross-sectional view of a diameter-decreased temperature control apparatus of a second embodiment of the present invention. The temperature control apparatus comprises a diameter-decreased circular powder reservoir T2, a heat exchanger A, a gas distribution tube assembly for making powder flow B, a pair of level controllers L (L1, L2) mounted on the reserving portion 1, and a powder buffer C. The heat exchanger A consists of two spiral heat exchangers A1 and A2 coupled to each other, and has a heat carrier inlet 5 and a heat carrier outlet 6. The spiral heat exchangers A1, A2 have a diameter (mϕ, nϕ) different from each other.

The pair of level controllers L mounted on the reserving portion 1 consists of a level controller L1 for controlling the maximum amount of powder to be received which is conveyed by a conveyer such as a bucket elevator which is not shown in the drawings, and a level controller L2 for controlling the minimum amount of powder. These level controllers L1 and L2 control the conveyers to allow the powder to be received automatically in order to keep the amount of powder in the reserving portion 1 constant. The powder may be supplied to the reserving portion 1 of the powder reservoir T as a batch of the powder or continuously.

The powder buffer C allows a good flow state of the powder in the heat exchange portion without being influenced by the weight of the powder conveyed into the reserving portion 1 according to the control by the level controllers L (L1, L2), and allows powder to be supplied from the reserving portion to the heat exchange portion without any trouble after the discharge of powder. The powder buffer also suppresses the occurrence of dust and makes the temperature of powder uniform due to the mixing operation at the discharge of the powder when the powder buffer is disposed near the lower part of the gas distribution tube assembly B. Such a powder buffer may be provided both near the upper part of the heat exchanger A and near the lower part of the gas distribution tube assembly B. A vibration portion or vibration transfer portion may be connected to these powder buffer C to prevent the powder from building up, and to promote smooth cooling (heating).

There is no limit to the shape of the powder buffer C provided that it has the functions described above. However, the powder buffer C may have a shape allowing powder to flow down in order to supply powder from the reserving portion to the heat exchange portion after powder is discharged from the outlet D. For example, the powder buffer C is so shaped to have a slope with incline of more than an angle of repose and/or to have a plurality of openings having a size allowing powder to pass through them. In some cases, a smooth treatment such as a fluorine resin treatment may be given to the surface of the powder buffer C. Specifically, the power buffer C may have a shape like a plate, a lattice, a board having rectangular holes, a hat, a mountain, a cone, a pyramid, a trumpet, and in particular, preferably a cone as shown in FIG. 2. A plurality of such powder buffers may be provided in parallel. The powder buffer C is generally made of metal. But there is no limit to the material of the powder buffer C, which may be made of other material such as pottery, fiber reinforced plastic, plastic, or wood.

The spiral heat exchanger A, gas distribution tube assembly B, and powder buffer C may be mounted on the powder reservoir T by conventional fixing means such as welding, bolts, and/or jig.

Consequently, the temperature of powder processed by a temperature control apparatus equipped with a temperature control unit according to the present invention may be generally controlled to 20 to 70° C. according to the purpose of use, and preferably to 20 to 50° C. Thus, for example, in case of resin-coated sand, the reduction of mold productivity resulting from the extension of baking time, the occurrence of mold breakage, etc. can be avoided also in winter, and in case of cold box process, mold breakage resulting from hardened coated-sand in winter or short bench life in summer can be avoided.

As described above in detail, a temperature control unit according to the present invention and a temperature control apparatus using it have the advantages described below.

(1) The temperature control unit according to the present invention basically comprises a spiral heat exchanger which has a heat exchange portion having constructive vertical and horizontal extent corresponding to the vertical and horizontal extent of a powder reservoir, and has excellent heat exchange ability, and a gas distribution tube assembly for making powder flow which supplies gas causing the powder flow state in which replacement or mixing of the powder may be caused, that is, powder is moving but not floating, and thereby an exiting powder reservoir placed at a service place can be easily modified to a temperature control apparatus having a heat exchange portion corresponding to the amount of the process of powder, and having a size smaller than conventional temperature control apparatus. Thus, installation space and provision cost can be reduced compared with conventional apparatuses, and the occurrence of powder dust and the exfoliation of the resin film can be prevented.

(2) A pair of level controllers and a powder buffer are provided on the reserving portion of a diameter-decreased temperature control apparatus comprising a powder reservoir and a temperature control unit described in (1) provided on the power reservoir and, thereby, the amount of powder in the reserving portion is kept constant and powder is supplied from the reserving portion to the heat exchange portion without any trouble after the discharge of powder without interfering with powder flow at the heat exchange portion due to the weight of the powder in the reserving portion, and a temperature control apparatus capable of continuously processing powder can consequently be provided. In addition to that, the occurrence of dust can be suppressed, and when the powder buffer is disposed near the lower part of the gas distribution tube assembly, the temperature of powder can be made uniform by the mixing operation at the discharge of powder.

(3) In the temperature control apparatus according to the present invention, it is easy to stop or restart the heating or cooling by the combination of the temperature control apparatus and a heat carrier supply device capable of switching between heating and cooling, and thereby the temperature control apparatus can contribute to reduced work in such a manner that the worker is liberated from an annoyance such as the work of discharging the powder from the temperature control apparatus in an intermission or at the end of work.

(4) In the temperature control apparatus according to the present invention, the gas in the heat exchange portion diffuses and comes up to the reserving portion, and while the gas is diffusing and coming up to the reserving portion, heat transfers from the gas to the unprocessed powder, or vice versa. This contributes to the reduction of heat treatment cycle and energy cost.

What is claimed is:

1. A foundry sand temperature control unit for raw molding sand or resin-coated sand for a shell mold, comprising a heat exchanger including a helical hollow tube allowing heat carrier to flow, and a gas distribution tube assembly for making powder flow for supplying gas to cause the flow of raw molding sand or resin-coated sand for a shell mold.

2. The temperature control unit of claim 1 further comprising a buffer for preventing the influence of the weight of raw molding sand or resin-coated sand for a shell mold disposed above said heat exchanger and/or under said gas distribution tube assembly for making powder flow.

3. A temperature control unit of claim 1, wherein said gas distribution tube assembly for making powder flow has a plurality of gas diffusing holes.

4. A temperature control unit of claim 1, wherein the lower part of said gas distribution tube assembly for making powder flow has a plurality of gas diffusing holes.

5. A temperature control unit of claim 2, wherein the lower part of said gas distribution tube assembly for making powder flow has a plurality of gas diffusing holes.

6. A foundry sand temperature control apparatus for raw molding sand or resin-coated sand for a shell mold, wherein a temperature control unit for raw molding sand or resin-coated sand for a shell mold comprising a heat exchanger including a helical hollow tube allowing heat carrier to flow, and a gas distribution tube assembly for making powder flow for supplying gas to cause the flow of raw molding sand or resin-coated sand for a shell mold Is provided in a reservoir for raw molding sand or resin-coated sand for a shell mold.

7. A foundry sand temperature control apparatus for raw molding sand or resin-coated sand for a shell mold, wherein a temperature control unit for raw molding sand or resin-coated sand for a shell mold comprising a heat exchanger including a helical hollow tube allowing heat carrier to flow, a gas distribution tube assembly for making powder flow for supplying gas to cause the flow of raw molding sand or resin-coated sand for a shell mold, arid a buffer for preventing the influence of the weight of raw molding sand or resin-coated sand for a shell mold disposed above said heat exchanger and/or under said gas distribution tube assembly for making powder flow is provided in a reservoir for raw molding sand or resin-coated sand for a shell mold.

8. A foundry sand temperature control apparatus for raw molding sand or resin-coated sand for a shell mold, wherein a temperature control unit for raw molding sand or resin-coated sand for a shell mold comprising a heat exchanger including a helical hollow tube allowing heat carrier to flow, and a gas distribution tube assembly for making powder flow for supplying gas to cause the flow of raw molding sand or resin-coated sand for a shell mold, which has a plurality of gas diffusion holes, is provided in a reservoir for raw molding sand or resin-coated sand for a shell mold.

9. A foundry sand temperature control apparatus for raw molding sand or resin-coated sand for a shell mold, wherein a temperature control unit for raw molding sand or resin-coated sand for a shell mold comprising a heat exchanger including a helical hollow tube allowing heat carrier to flow, and a gas distribution tube assembly for making powder flow for supplying gas to cause the flow of raw molding sand or resin-coated sand for a shell mold, the lower part of which has a plurality of gas diffusion holes, is provided in a reservoir for raw molding sand or resin-coated sand for a shell mold.

10. A foundry sand temperature control apparatus for raw molding sand or resin-coated sand for a shell mold, wherein a temperature control unit for raw molding sand or resin-coated sand for a shell mold comprising a heat exchanger including a helical hollow tube allowing heat carrier to flow, a gas distribution tube assembly for making powder flow for supplying gas to cause the flow of raw molding sand or resin-coated sand for a shell mold, the lower part of which has a plurality of gas diffusion holes, and a buffer for preventing the influence of the weight of raw molding sand or resin-coated sand for a shell mold disposed above said heat exchanger or under said gas distribution tube assembly for making powder flow is provided in a reservoir for raw molding sand or resin-coated sand for a shell mold.

11. A temperature control apparatus for raw molding sand or resin-coated sand for a shell mold of claim 6 further comprising a pair of level controllers disposed on the reserving portion at the upper part of the reservoir for raw molding sand or resin-coated sand.

12. A temperature control apparatus for raw molding sand or resin-coated sand for a shell mold of claim 7 further comprising a pair of level controllers disposed on the reserving portion at the upper part of the reservoir for raw molding sand or resin-coated sand.

13. A temperature control apparatus for raw molding sand or resin-coated sand for a shell mold of claim 8 further comprising a pair of level controllers disposed on the reserving portion at the upper part of the reservoir for raw molding sand or resin-coated sand.

14. A temperature control apparatus for raw molding sand or resin-coated sand for a shell mold of claim 10 further comprising a pair of level controllers disposed on the reserving portion at the upper part of the reservoir for raw molding sand or resin-coated sand.

15. A temperature control apparatus for raw molding sand or resin-coated sand for a shell mold of claim 6 capable of switching between the heating or cooling of raw molding sand or resin-coated sand for a shell mold.

16. A temperature control apparatus for raw molding sand or resin-coated sand for a shell mold of claim 8 capable of switching between the heating or cooling of raw molding sand or resin-coated sand for a shell mold.

17. A temperature control apparatus for raw molding sand or resin-coated sand for a shell mold of claim 10 capable of switching between the heating or cooling of raw molding sand or resin-coated sand for a shell mold.

18. A temperature control apparatus for raw molding sand or resin-coated sand for a shell mold of claim 12 capable of switching between the heating or cooling of raw molding sand or resin-coated sand for a shell mold.

19. A temperature control apparatus for raw molding sand or resin-coated sand for a shell mold of claim 13 capable of switching between the heating or cooling of raw molding sand or resin-coated sand for a shell mold.

20. A temperature control apparatus for raw molding sand or resin-coated sand for a shell mold of claim 14 capable of switching between the heating or cooling of raw molding sand or resin-coated sand for a shell mold.

* * * * *